US006077087A

United States Patent [19]

Endres et al.

[11] Patent Number: 6,077,087

[45] Date of Patent: Jun. 20, 2000

[54] COAXIAL CONNECTOR MODULE WITH AN OVERMOLDED GROUND CONTACT

[75] Inventors: Herbert Endres, Bad Wimfen; Otto Schempp, Bad Rappenau, both of Germany

[73] Assignee: Molex Incorporated, Lisle, Ill.

[21] Appl. No.: 09/114,707

[22] Filed: Jul. 13, 1998

[30] Foreign Application Priority Data

Jul. 21, 1997 [EP] European Pat. Off. ..... 97112452

[51] Int. Cl.[7] ..... H01R 12/00

[52] U.S. Cl. ..... 439/63; 439/541.5

[58] Field of Search ..... 439/63, 579, 541.5, 439/736, 620, 578–585, 79, 80; 29/825, 828, 829, 830

[56] References Cited

U.S. PATENT DOCUMENTS

| | | | |
|---|---|---|---|
| 4,431,253 | 2/1984 | Hochgesang et al. | 439/675 |
| 4,598,961 | 7/1986 | Cohen | 439/63 |
| 4,718,854 | 1/1988 | Capp et al. | 439/63 |
| 5,186,656 | 2/1993 | Harwath etal. | 439/585 |
| 5,334,050 | 8/1994 | Andrews | 439/579 |
| 5,344,340 | 9/1994 | Bouleau | 439/581 |
| 5,679,006 | 10/1997 | Madelaine | 439/63 |
| 5,842,872 | 12/1998 | Hosler, Sr. et al. | 439/63 |

FOREIGN PATENT DOCUMENTS

WO 9617410 6/1996 WIPO .

*Primary Examiner*—Steven L. Stephan
*Assistant Examiner*—Barry M. L. Standig
*Attorney, Agent, or Firm*—A. A. Tirva

[57] ABSTRACT

A coaxial connector module includes an external, generally cylindrical ground contact having a side opening. An internal, generally centrally located signal contact is disposed within the ground contact. A signal terminal extends from the signal contact transversely outwardly through the side opening in the ground contact. A ground plane embraces the ground contact and has a ground terminal extending transversely outwardly therefrom. A dielectric substrate is overmolded about the ground contact, the signal contact, the signal terminal and the ground plane to hold these components in assembled condition as a module.

16 Claims, 5 Drawing Sheets

COAXIAL CONNECTOR MODULE WITH AN OVERMOLDED GROUND CONTACT

FIELD OF THE INVENTION

This invention generally relates to the art of electrical connectors and, particularly, to a coaxial connector module for connection to a printed circuit board or other connecting device.

BACKGROUND OF THE INVENTION

Coaxial connectors have been used to electrically connect various signal transmission devices. For instance, coaxial connectors are known for interconnection to printed circuit boards. A coaxial connector socket is mounted on one of the boards, and a coaxial connector plug is mounted on the other board. The boards may be interconnected in a parallel configuration, or the boards may be interconnected perpendicularly with respect to one another.

A typical coaxial connector socket includes a generally cylindrical external ground contact surrounding an inner signal contact pin. The ground contact and the signal contact are held together by a dielectric housing. An open end of the cylindrical ground contact defines a receptacle or socket for receiving a mating coaxial plug connector. Terminal leads are provided at a rear or terminating end of the coaxial connector socket, with the terminal leads extending outwardly for connection to a connecting device such as a printed circuit board.

Heretofore, one of the problems with coaxial connectors of the character described above has been that they perform rather simple functions but they are disproportionately expensive to manufacture. The present invention is directed to solving this problem by providing a very simple coaxial connector module which is inexpensive to fabricate, the invention including the method of fabrication.

SUMMARY OF THE INVENTION

An object, therefore, of the invention is to provide a new and improved coaxial connector module for connection to another connecting device such as a printed circuit board.

In the exemplary embodiment of the invention, the connector module includes an external, generally cylindrical ground contact having a side opening. An internal, generally centrally located signal contact is disposed within the ground contact. A signal terminal extends from the signal contact transversely outwardly through the side opening in the ground contact. A ground plane embraces the ground contact and has a ground terminal extending transversely outwardly therefrom. A dielectric substrate is interengaged with the ground contact, the signal contact, the signal terminal and the ground plane to hold these components in assembled condition as a module.

As disclosed herein, a second ground plane embraces the ground contact spaced axially from the first ground plane, and the second ground plane also has a ground terminal extending transversely outwardly from the ground contact. The signal terminal is disposed between and spaced from the two ground planes. Preferably, the dielectric substrate is of plastic material overmolded about at least portions of the ground contact, the signal contact, the signal terminal and the ground planes.

The signal terminal and the ground terminal may include tail portions adapted for insertion into appropriate holes in a printed circuit board. On the other hand, the signal terminal and the ground terminal may include portions adapted for surface connection to appropriate circuit traces on the surface of the printed circuit board. Further, the tail portions of the signal terminal and the ground terminal may be bent to extend generally parallel to the axis of the generally cylindrical ground contact.

The invention contemplates that a plurality of the generally cylindrical ground contacts can be provided in a single module. Each cylindrical ground contact has one of the internal signal contacts therewithin, and with one of the signal terminals extending from each signal contact. The one or more ground planes embrace all of the plurality of cylindrical ground contacts.

Lastly, the invention contemplates a method of assembling the coaxial connector module described above, wherein the various components are relatively positioned, and the dielectric substrate is overmolded about at least portions of the components to hold the components in assembled condition as a module.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
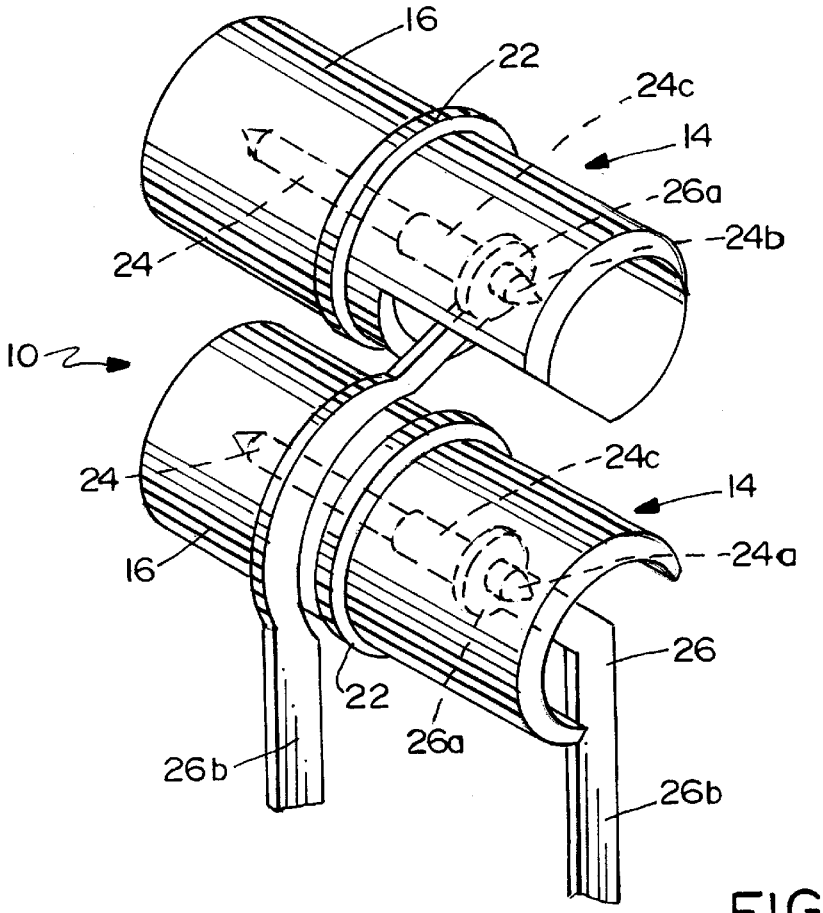
FIG. 1 is a perspective view of a coaxial connector module incorporating the concepts of the invention.
Figure 2:
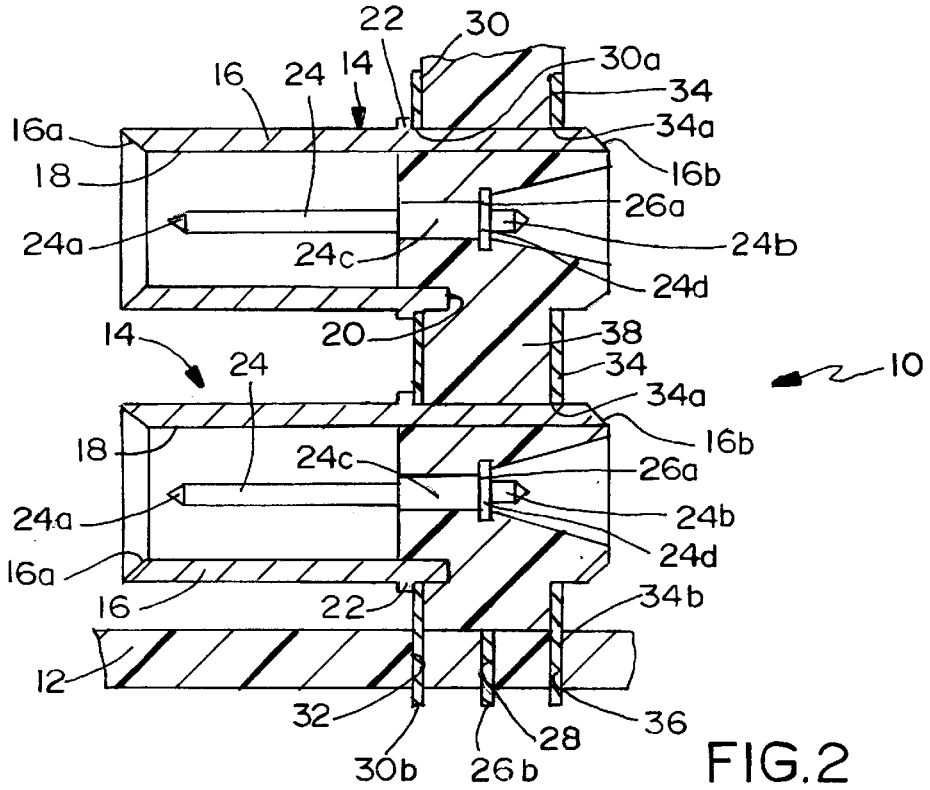
FIG. 2 is a vertical section through the module, connected to a printed circuit board.
Figure 3A:
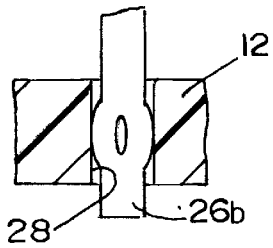
FIG. 3A is a partial view of a tail portion and printed circuit board shown FIG. 3.
Figure 3:
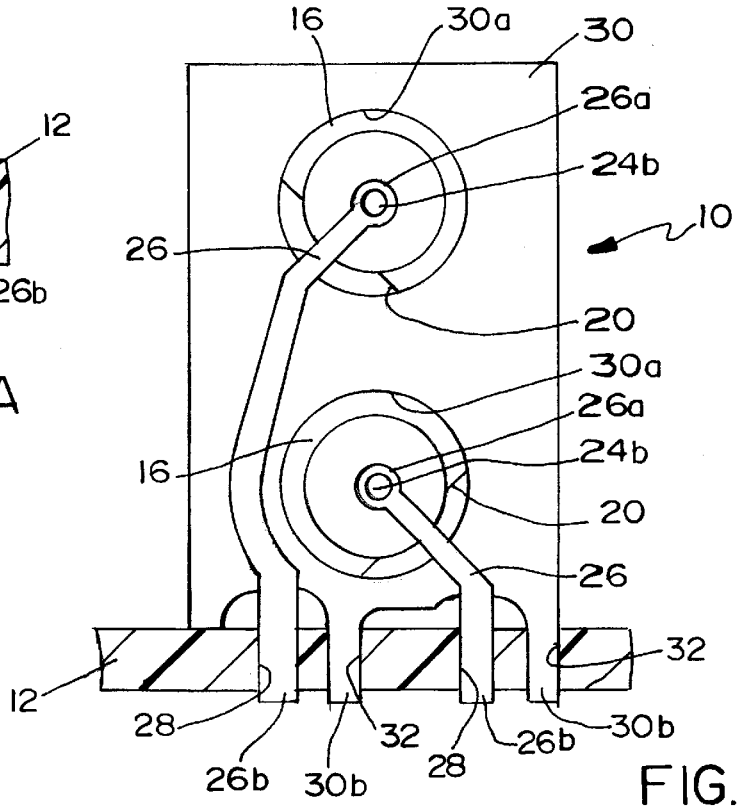
FIG. 3 is a side elevational view of the module, with one of the ground planes and the overmolded substrate removed to facilitate the illustration.
Figure 4:
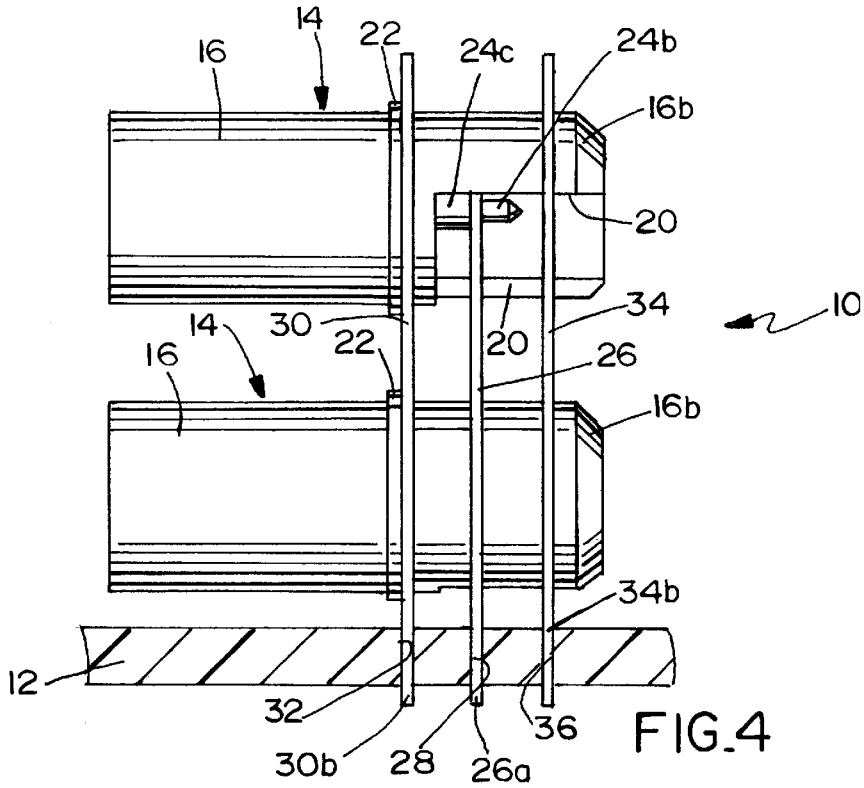
FIG. 4 is a side elevational view perpendicular to that of FIG. 3, with the overmolded substrate removed to facilitate the illustration.

Referring to the drawings in greater detail, and first to FIGS. 1–4, the invention is embodied in a coaxial connector module, generally designated 10, which is shown in the drawings adapted for mounting on a printed circuit board. For instance, FIGS. 2–4 show the module mounted on a printed circuit board 12 in a "right-angled" configuration whereby the sockets of the coaxial connectors extend generally parallel to the board. However, it should be understood that the concepts of the invention are equally applicable for use in other types of mounting applications.

More particularly, connector module 10 is shown to include two coaxial connectors, generally designated 14, although the invention contemplates that certain applications may involve only one or more than two connectors. Each coaxial connector 14 includes an external, generally cylindrical ground contact 16 having an open receptacle or socket end 16*a* and an opposite termination end 16*b*. The open end 16*a* of each ground contact 16 defines a socket or receptacle for receiving a complementary coaxial connector plug (not shown). The termination end 16*b* of each ground contact 16 has a side opening 20 which can be seen quite clearly in FIGS. 3 and 4. A peripheral flange 22 projects radially outwardly from the exterior of each ground contact 16.

An internal, generally centrally located signal contact pin 24 is disposed within each ground contact 16. Each signal contact pin has a mating end 24*a*, a termination end 24*b* and an enlarged portion 24*c* spaced slightly inwardly from termination end 24*b* to define a shoulder 24*d*.

Generally, a signal terminal 26 extends from each signal contact 24 transversely outwardly through the side opening 20 of the respective ground contact 16 within which the signal terminal is located. More particularly, each signal terminal 26 includes an inner circular end 26*a* which surrounds termination end 24*b* of the respective signal contact 24, as by a press-fit. Each signal terminal 26 has an outer tail portion 26*b* for connection to circuit traces on printed circuit board 12. For instance, tail portions 26*b* of the signal terminals can be inserted into holes 28 in printed circuit board 12 for solder connection to appropriate circuit traces on the board and/or in the holes.

Coaxial connector module 10 includes a first ground plane 30 which embraces ground contacts 16 and which seats against the termination side of outwardly projecting peripheral flanges 22 of the ground contacts. In essence, first ground plane 30 includes circular apertures 30*a* (FIGS. 2 and 3) which surround ground contacts 30, as by a pressfit. Ground plane 30 has a pair of tail portions 30*b* which project into holes 32 in printed circuit board 12 for solder connection to appropriate circuit traces on the board and/or in the holes.

A second ground plane 34 also is provided with circular apertures 34*a* for surrounding and establishing a press-fit with ground contacts 16. Second ground plane 34 is spaced axially from first ground plane 30. Like the first ground plane, the second ground plane includes a pair of tail portions 34*b* which extend into holes 36 in printed circuit board 12 for solder connection to appropriate circuit traces on the board and/or in the holes.

Coaxial connector module 10 includes a dielectric substrate 38 which is interengaged with ground contacts 16, signal contacts 24, signal terminals 26, first ground plane 30 and second ground plane 34 to hold these components in assembled condition as a module, as shown in FIGS. 1 and 2. The dielectric substrate preferably is of a plastic material overmolded about at least portions of the ground contacts, the signal contacts, the signal terminals and the ground planes as seen in FIG. 2. As also seen in FIG. 2, tail portions 26*b*, 30*b* and 34*b* of signal terminals 26, ground plane 30 and ground plane 34 project outwardly of overmolded substrate 38 for insertion into their respective holes in printed circuit board 12.

Signal terminals 26 and ground planes 30 and 34 can be fabricated by stamping these components from conductive sheet metal material. Although printed circuit board 12 is shown in FIG. 3, ground plane 34 and overmolded substrate 38 have been removed to facilitate the illustration in this depiction of the positional relationships between signal terminals 26 and ground plane 30 in a direction transversely of the connectors, along with a showing of how the signal terminals project outwardly through openings 20 in ground contacts 16. Similarly, in order to provide a clear understanding of the invention, although printed circuit board 12 is shown in FIG. 4, overmolded substrate 38 has been removed from this depiction to show the positional relationships between the signal terminals and the ground planes in a direction axially of the connectors, as well as another showing of how one of the signal terminals extends through the respective opening 20 in one of the ground contacts 16.

Figure 5:
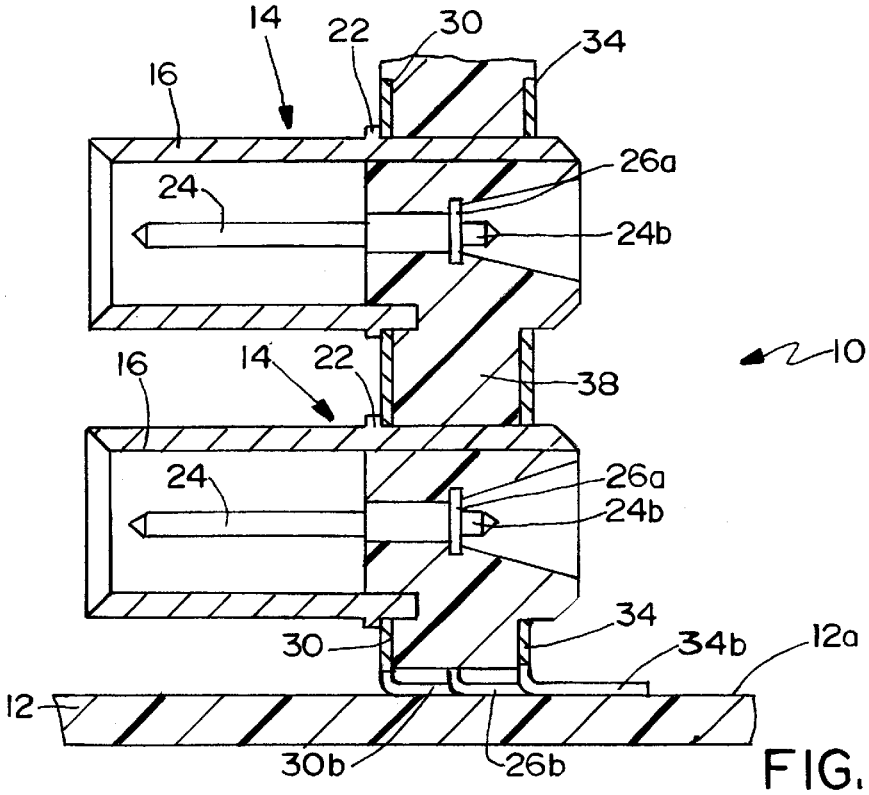
FIG. 5 is a sectional view similar to that of FIG. 2, with the tail portions of the terminals bent generally parallel to the axes of the ground contacts.
Figure 6:
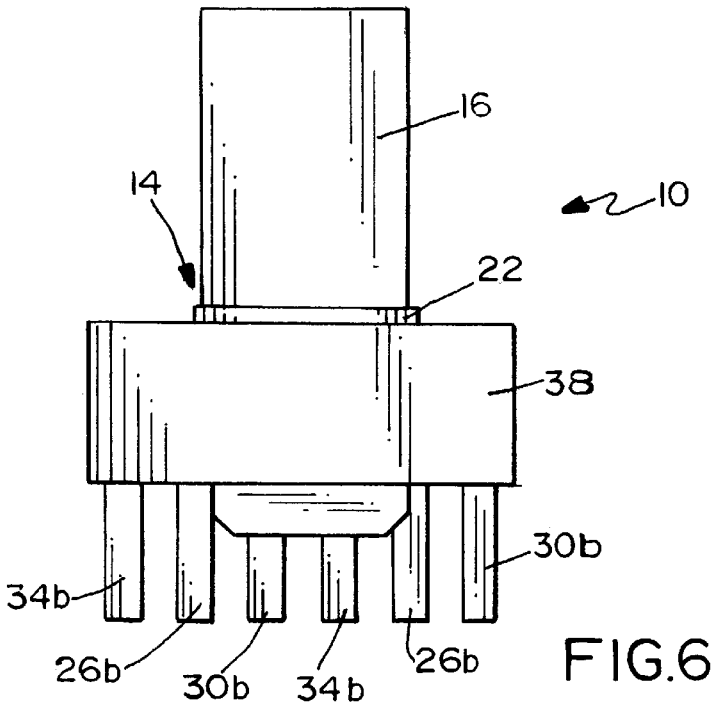
FIG. 6 is a side elevational view looking toward the left-hand side of FIG. 5.

FIGS. 5 and 6 show an alternate embodiment of the invention, wherein tail portions 26*b* of signal terminals 26, tail portions 30*b* of ground plane 30 and tail portions 34*b* of ground plane 34 all are bent generally perpendicular to the planes of these components and generally parallel to printed circuit board 12. With this configuration, coaxial connector module 10 is surface mounted to top surface 12*a* of the printed circuit board. However, the individual coaxial connectors 14 still are mounted in a right-angled orientation similar to the depiction of FIG. 2 wherein the tail portions extend through holes in the printed circuit board. Consequently, like reference numerals have been applied in FIGS. 5 and 6 to designate like components described above in relation to the embodiment of FIGS. 1–4.

Figure 8:
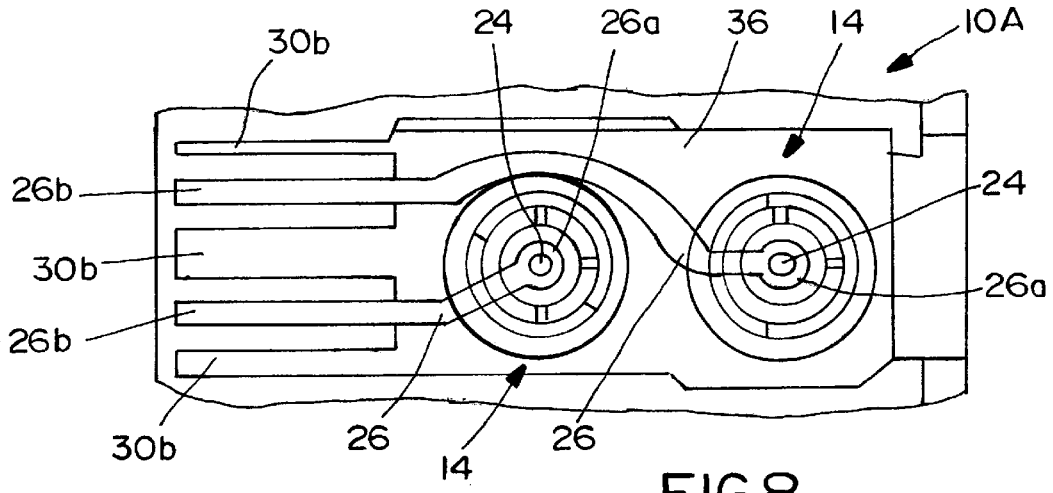
FIG. 8 is a top plan view of the module of FIG. 7.
Figure 7:
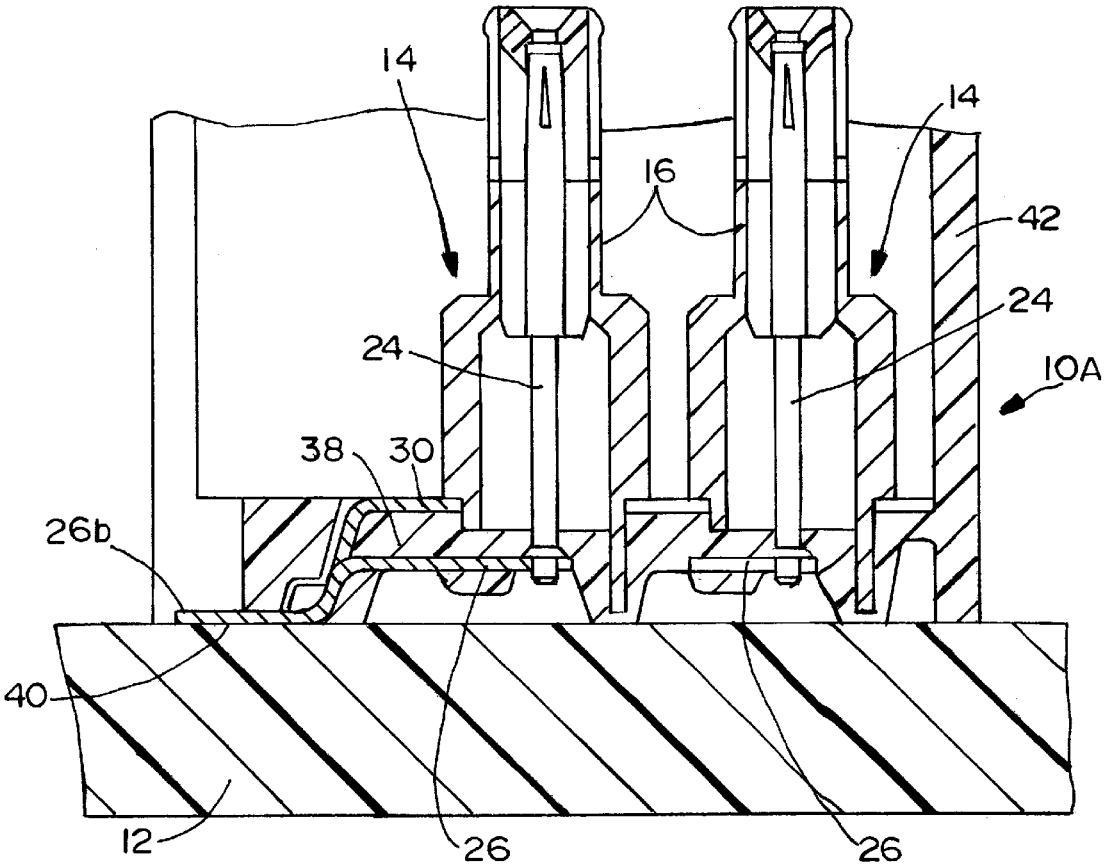
FIG. 7 is a sectional view through an alternate form of module surface, mounted on a printed circuit board, with the connectors projecting generally perpendicular to the board.

FIGS. 7 and 8 show a further embodiment of the invention wherein a coaxial connector module, generally designated 10A, is mounted on a printed circuit board 12, by a surface mount application, as at 40. Again, although the particular shapes of the various components may be different in the embodiment of FIGS. 7 and 8, like reference numerals have been applied in these figures to designate like functional components of coaxial connectors 14 of terminal module 10*a*. In this embodiment, an outer module housing 42 may be secured to the overmolded dielectric substrate 38 to surround coaxial connectors 14 of the module.

Figure 9:
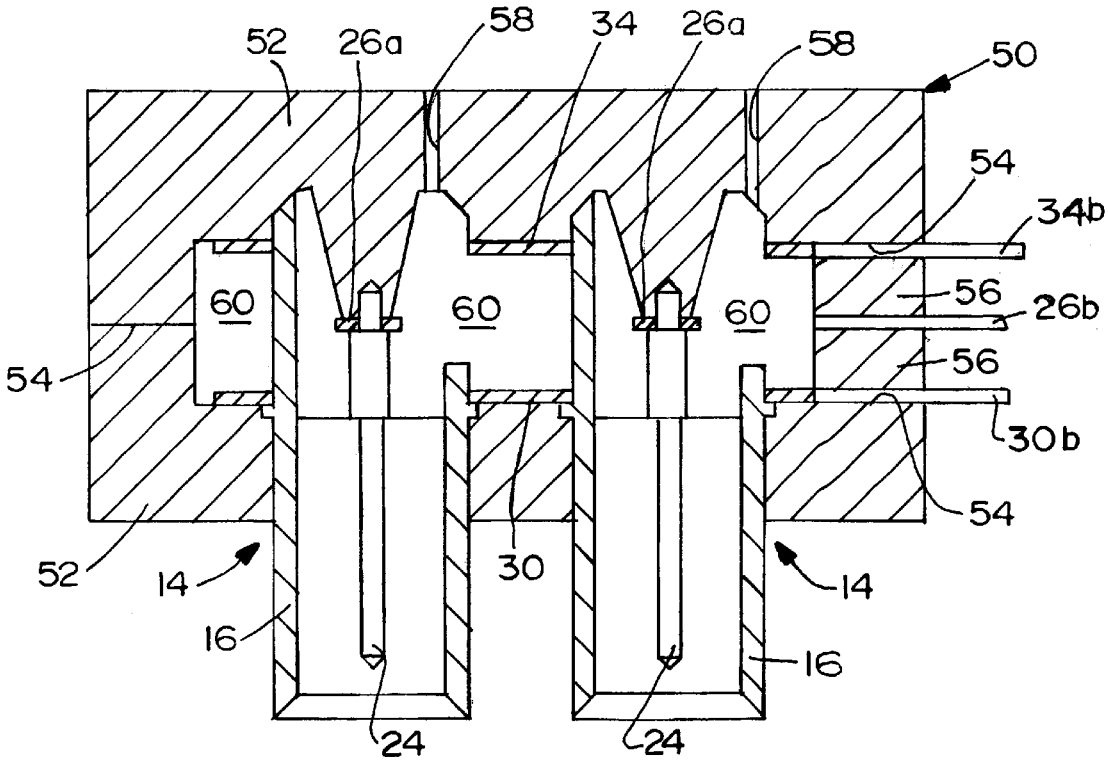
FIG. 9 is a sectional view of the tooling for overmolding of the dielectric substrate and various terminals and contacts.

The invention contemplates a method of fabricating coaxial connector module 10 (or 10A) according to the structural combination described above. Although a variety of molding dies or tooling can be designed by a man of ordinary skill in the art, FIG. 9 shows tooling, generally designated 50, which might be used to position the ground contacts, signal contacts, signal terminals and ground planes to facilitate overmolding dielectric substrate 38 about these components. Specifically, tooling 50 may include a pair of opposing mold dies 52 separable at parting lines 54 and which may include inserts 56. Injection holes 58 are provided at various points through the dies for the injection of molten dielectric plastic material into a die cavity 60 for forming dielectric substrate 38 and overmolding the substrate about the various components of the coaxial connectors of the coaxial connector module.

Figure 10:
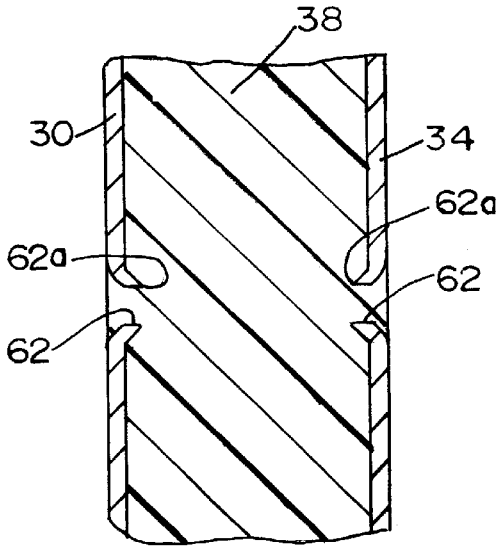
FIG. 10 is a fragmented section through the substrate and ground planes to show two of the fixing holes.

Lastly, FIG. 10 shows that ground planes 30 and 34 can be provided with punched or drawn fixing holes 62 having punched or drawn edges 62*a*. These edges become embedded in the overmolded plastic material of substrate 38 to hold the ground planes in position.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A coaxial connector module, comprising:

an external, generally cylindrical ground contact having a side opening;

an internal, generally centrally located signal contact within the ground contact;

a signal terminal extending from the signal contact transversely outwardly through the side opening in the ground contact;

a ground plane having an opening adapted to accommodate a first portion of the ground contact; and a dielectric substrate overmolded about at least portions of the ground contact, the signal contact, the signal terminal and the ground plane to hold these components in an assembled condition as a module and wherein said signal terminal and said ground terminal include tail portions adapted for insertion into appropriate holes in a printed circuit board.

2. The coaxial connector module of claim 1, including a second ground plane spaced axially from the first ground plane and having an opening adapted to accommodate a second portion of the ground contact.

3. The coaxial connector module of claim 2 wherein said signal terminal is disposed between and spaced from said two ground planes.

4. The coaxial connector module of claim 1 wherein said dielectric substrate is of plastic material overmolded about at least portions of the ground contact, the signal contact, the signal terminal and the ground plane.

5. The coaxial connector module of claim 1 wherein said signal terminal and said ground terminal include portions adapted for surface connection to appropriate circuit traces on a surface of a printed circuit board.

6. The coaxial connector module of claim 1 wherein said signal terminal and said ground terminal include tail portions bent to extend generally parallel to the axis of the generally cylindrical ground contact.

7. The coaxial connector module of claim 1, including a plurality of said generally cylindrical ground contacts each with one of the internal signal contacts therewithin and with one of the signal terminals extending from each signal contact, and said ground plane having a plurality of openings each opening adapted to accommodate a first portion of one of the plurality of ground contacts.

8. The coaxial connector module of claim 7, including a second ground plane spaced axially from the first ground plane and having a plurality of openings each opening adapted to accommodate a second portion of one of the plurality of ground contacts.

9. A coaxial connector module, comprising:

an external, generally cylindrical ground contact having a side opening;

an internal, generally centrally located signal contact within the ground contact;

a signal terminal extending from the signal contact transversely outwardly through the side opening in the ground contact;

a first ground plane having an opening adapted to accommodate a first portion of the ground contact;

a second ground plane spaced axially from the first ground plane and having an opening adapted to accommodate a second portion of the ground contact;

said signal terminal being disposed between and spaced from said first and second ground planes;

a dielectric substrate of plastic material overmolded about at least portions of the ground contact, the signal contact, the signal terminal and the first and second ground planes to hold these components in an assembled condition as a module; and said signal terminal and said ground planes including tail portions projecting from the dielectric substrate.

10. The coaxial connector module of claim 9 wherein said tail portions are configured for insertion into appropriate holes in a printed circuit board.

11. The coaxial connector module of claim 9 wherein said tails portions are configured for surface connection to appropriate circuit traces on a surface of a printed circuit board.

12. The coaxial connector module of claim 9 wherein said tail portions are bent to extend generally parallel to the axis of the generally cylindrical ground contact.

13. The coaxial connector module of claim 9, including a plurality of generally cylindrical ground contacts each with one of the internal signal contacts therewithin and with one of the signal terminals extending from each signal contact, and said ground plane having a plurality of openings each opening adapted to accommodate a portion of each one of the plurality of ground contacts.

14. A method of fabricating a coaxial connector module, comprising the steps of:

providing an external, generally cylindrical ground contact having a side opening;

positioning an internal, generally centrally located signal contact within the ground contact;

providing a signal terminal extending from the signal contact transversely outwardly through the side opening in the ground contact;

positioning a ground plane having an opening adapted to accommodate a portion of the ground contact;

overmolding a dielectric substrate about at least portions of the ground contact, the signal contact, the signal terminal and the ground plane to hold these components in an assembled condition as a module; and providing tail portions of said signal terminal and said ground plane projecting from the overmolded dielectric substrate.

15. The method of claim 14, including the step of bending said tail portions to extend generally parallel to the axis of the generally cylindrical ground contact.

16. The method of claim 14, including providing a plurality of said generally cylindrical ground contacts each with one of the internal signal contacts therewithin, with one of the signal terminals extending from each signal contact, and with said ground plane having a plurality of openings each opening adapted to accommodate a portion of one of the plurality of ground contacts, and said step of overmolding the dielectric substrate includes overmolding the substrate about all of the plurality of ground contacts, the signal contacts and their respective signal terminals.

* * * * *